United States Patent [19]

Patil et al.

[11] 4,210,515

[45] Jul. 1, 1980

[54] THERMOPLASTIC FIBERS AS SEPARATOR OR DIAPHRAGM IN ELECTROCHEMICAL CELLS

[75] Inventors: Arvind S. Patil, Grosse Ile; Shyam D. Argade, Woodhaven, both of Mich.

[73] Assignee: BASF Wyandotte Corporation, Wyandotte, Mich.

[21] Appl. No.: 548,684

[22] Filed: Feb. 10, 1975

[51] Int. Cl.[2] ..... C25B 1/16; C25B 1/26; C25B 13/08

[52] U.S. Cl. ..... 204/266; 204/252; 204/258; 204/296

[58] Field of Search ..... 204/98, 128, 296, 295, 204/252, 266, 282, 80; 162/164 R, 146

[56] References Cited

U.S. PATENT DOCUMENTS

| | | | |
|---|---|---|---|
| 1,862,244 | 6/1932 | Stuart | 204/282 X |
| 2,526,125 | 10/1950 | Francis, Jr. | 162/146 |
| 3,200,033 | 8/1965 | Grossteinbeck et al. | 162/164 R X |
| 3,407,249 | 10/1968 | Landi | 204/296 X |
| 3,583,891 | 6/1971 | Hacker | 204/295 X |
| 3,694,281 | 9/1972 | Leduc | 156/77 |
| 3,723,264 | 3/1973 | Leduc et al. | 204/80 |
| 3,853,720 | 12/1974 | Korach et al. | 204/98 |
| 3,853,721 | 12/1974 | Darlington et al. | 204/98 |
| 3,928,166 | 12/1975 | O'Leary | 204/296 X |
| 3,945,910 | 3/1976 | DeCeuster et al. | 204/296 |

FOREIGN PATENT DOCUMENTS

| | | | |
|---|---|---|---|
| 700296 | 12/1964 | Canada | 204/296 |
| 1081046 | 8/1967 | United Kingdom . | |
| 1410313 | 10/1975 | United Kingdom | 204/296 |

OTHER PUBLICATIONS

U.S. Application #324,508, 1-17-73.

DuPont, Product Information Bulletin, (1972), "New Ion Exchange Membrane Vital in Disinfecting Sewage".

*Primary Examiner*—Arthur C. Prescott

*Attorney, Agent, or Firm*—Joseph D. Michaels; Arnold S. Weintraub

[57] ABSTRACT

Discrete thermoplastic fibers of fluorohydrocarbons and other self-bonding thermoplastic fibers are deployed as separators or diaphragms in electrochemical cells.

15 Claims, No Drawings

THERMOPLASTIC FIBERS AS SEPARATOR OR DIAPHRAGM IN ELECTROCHEMICAL CELLS

BACKGROUND OF THE INVENTION

1. Field of the Invention

The present invention pertains to electrochemical cells for the manufacture of chlorine and caustic soda and the like. More particularly, the present invention pertains to separators or diaphragms for electrochemical cells. Even more particularly, the present invention pertains to thermoplastic fibers for use as separators or diaphragms for electrochemical cells.

2. Prior Art

The manufacture of chlorine and caustic by the electrolytic decomposition of brine in electrochemical cells is well known. Conventionally, the electrochemical cells deploy asbestos diaphragms to separate the anodes and cathodes mounted in the cells. Varying constructions of conventional electrochemical cells are taught in the prior art. See inter alia, U.S. Pat. Nos. 3,312,614; 3,374,164, and Kuhn, *Industrial Electrochemical Processes,* Elsevier Publishing Co., 1971.

However, as is known to those skilled in the art, the use of asbestos diaphragms have certain inherent disadvantages. Asbestos tends to swell in the presence of the cell liquor which, in turn, results in a reduction of the mechanical strength and gradual wearing out of the diaphragm. Thus, there is the need for constant replacement of asbestos diaphragms which necessitates the closing down of the cell.

The required down time of the cells adds to the cost of operating these electrochemicals cells. Yet, because of the multitude of advantages attendant the use of asbestos diaphragms, they still dominate the field.

Thus, a major advancement would be provided by diaphragms which have all the inherent advantages of asbestos, but which eliminates the disadvantages thereof.

SUMMARY OF THE INVENTION

In accordance with the present invention, discrete thermoplastic fibers having a predetermined diameter are deposited on the cathode of an electrochemical cell to define a thermoplastic diaphragm.

The thermoplastic fibers hereof have a diameter of from about 0.05 to forty microns.

The fibers can be used to form diaphragms by any conventional technique, such as vacuum deposition on cathode screens or the direct deployment thereof as a preformed web.

The present invention contemplates the use of any thermoplastic that can be processed into a self-bonding fiber. Preferably, stable fluorohydrocarbon fibers are employed.

Further, the present invention contemplates the inclusion into the fibers of permanent wetting agents to promote the wetting of the hydrophobic surfaces of the fibers. The wetting agents can be either organic or inorganic compounds.

Also, the present invention provides a method of dispersing the fibers, and vacuum depositing them on a cathode screen to produce fibers having a controlled porosity through fiber alignment.

For a more complete understanding of the present invention, reference is made to the following detailed description and accompanying examples.

DESCRIPTION OF THE PREFERRED EMBODIMENTS

As herein before noted, the present invention contemplates the formation of diaphragms for use in electrochemical cells from discrete thermoplastic fibers having a predetermined diameter, the fibers being self-bonding.

At the outset, it is to be noted that the term "electrochemical cells", as used herein, contemplates any type of cell wherein an electrolytic solution or cell liquor is passed through an electrical field, generated between an anode and a cathode, to break down the electrolyte or to synthesize chemicals. Thus, chlorates, chlorides, carbonates, hydroxides, dithionites and the like are manufactured and recovered from these cells. The present invention contemplatesthe usage thereof in any conventional electrochemical cell. The present invention is specifically adapted for use in a bipolar electrolysis cell wherein a brine solution is used for the manufacture of chlorine and caustic soda. These cells are generally referred to as chlor-alkali cells or electrolytic cells for the manufacture of chlorine and caustic.

Chlor-alkali cells are typically defined as either conventional diaphragm cells having a graphite or dimensionally stable coated metal anode, or a bipolar electrolytic filter press cell with similar anodes. Both of these types of cells are well known. Hence, the present invention enjoys particular applicability to both of these types of bipolar chlor-alkali cells.

Furthermore, and as is also well known to those skilled in the art, associated with the cathodes in the cells are diaphragms or separators which keep the cathode and anode compartments separate. Because of the internal conditions within the cells, it is necessary that any diaphragm material exhibit resistance to chemical degradation. Additionally, such materials must exhibit low electrical resistance and adequate hydraulic permeability. By exhibiting such properties there is provided a reduction in power consumption, higher caustic concentration in the cell and reduced cost of operation. By the practice of the present invention such is achieved.

It has now been found, and in accordance herewith, that discrete thermoplastic self-bonding fibers having a diameter of about 0.05 to forty microns can be efficaciously deployed as diaphragm materials in electrochemical cells. Preferably, the fibers have a diameter of about 0.05 to 10 microns.

It should be noted that as defined herein, the term "self-bonding" contemplates the bonding of one fiber to another by the heat treatment thereof. Generally speaking, the fibers hereof have the ability to bond to one another at temperatures of from about 100° C. to 300° C. when so subjected for a period of from about one-half hour to one hour.

Because of the nature of the internal conditions within the chlor-alkali cells, the preferred thermoplastic fibers are fluorohydrocarbons, and specifically, fluorinated polyalkylenes, which have been found to be self-bonding. The polyalkylenes can be, additionally, halogenated polyalkylenes. Representative fluorinated polyalkylenes, as contemplated herein, include, for example, polytetrafluoroethylene, fluorinated ethylene-propylene copolymers, polychlorotrifluoroethylene, chlorotrifluoroethylene, polyvinylidenefluoride, polyethylenechlorotrifluoroethylene, polyethylenetetrafluoroethylene, and tetrafluoroethylene-perfluorovinylether sulfonyl fluoride copolymers. Additionally, blends of fluorohydrocarbons, as well as blends of fluorohydrocarbons with other thermoplastic materials, can be effectively utilized herein. Also polyarylsulfones can be effectively employed herein, especially as a preformed web.

Representative of the other thermoplastic materials contemplated for use herein are, for example, self-bonding polyolefins, polycarbonates, polyesters, polyamides, and the like, as well as mixtures thereof which can have fibers formed therefrom within the specified diameter. Representative suitable thermoplastic compounds include polyethylene, polypropylene, hexamethylene adipamide and other nylons, polyethylene terephthalate, poly-4-methylpentene-1, poly(tetramethylene) terephthalate, polystyrene-polyvinylidene chloride copolymers, polycarbonates of 2-(4-hydroxylmethyl) propane (Bisphenol A), polyphenylyene oxide and the like, as well as mixtures thereof.

Because of the hydrophobic nature of the thermoplastic fibers, it is necessary to include within the internal structure or matrix of the fibers, per se, a hydrophilic material to ensure the wetting ability of the fibers. Any wetting agent that can withstand the processing parameters of the fiber formation, i.e. a temperature of from about 600° to 700° F., can be utilized herein. The wetting agent can be organic or inorganic. Suitable organic wetting agents or surfactants are the nonionic and anionic surfactants.

Useful nonionic surfactants include the oxyalkylene condensates of ethylene diamine, such as the ethylene oxidepropylene oxide block copolymers prepared by the sequential addition thereof to ethylene diamine, and as described in U.S. Pat. No. 2,979,528.

Other useful organic surfactants include polyoxyethylene alkylphenols, polyoxyethylene alcohols, polyoxyethylene esters of fatty acids, polyoxyethylene mercaptans, polyoxyethylene alkylamines, polyoxyethylene alkylamides, polyol surfactants, and the like.

Suitable inorganic wetting agents which can be internally incorporated into the fibers include, for example, asbestos, mica, titanates, such as barium titanate, potassium titanate, talc, vermiculite, titanium dioxide, boron nitrides, kaolinite, diatomaceous earth and clays, as well as mixtures thereof.

In the practice of the present invention, the preferred surfactant or wetting agents are the perfluorinated fatty acids, alcohols or sulfonate-based surfactants which exhibit temperature stability to about 600° F. to 700° F. These surfactants are widely known and commercially available. They are sold under a plurality of trademarks, such as FLUORAD FC-126, or FC-170; and ZONYL FSM, FSA or FSP. These surfactants have been found to impart the best wettability to the fibers when internally added thereto.

In incorporating the wetting agent, generally, from about 0.01 to 10% by weight thereof, and preferably, from about 0.1 to 3% thereof, by weight, based on the weight of the thermoplastic material, is incorporated therewith. The wetting agent is introduced internally to the fiber by any conventional method.

In forming the thermoplastic fibers hereof any suitable or conventional process for thermoplastic fiber formation can be utilized. The only criticality attached hereto is that the resulting fibers have a diameter of about 0.05 to forty microns. It should be noted that one particularly preferred method for forming the fibers hereof comprises the melt blowing processes. Processes for producing melt-blown fibers are well known. See, inter alia, U.S. Pat. No. 3,755,527. Another useful process is the solution spinning process such as described in Belgian Pat. No. 795,724. It is to be understood, however, that the process by which the fibers are formed, is not critical hereto. Rather, it is the use of such fibers which is critical hereto.

In utilizing the fibers hereof any suitable process for the production of diaphragms can be adopted. Thus, diaphragms, produced in accordance herewith, can be manufactured by vacuum deposition. Vacuum deposition processes generally comprise the introduction of an aqueous or non-aqueous slurry containing from about 0.5% to 3.0%, by weight, of fiber onto a cathode screen. A partial vacuum is, then, applied across the cathode screen for about one-half to ten minutes to densify the fibers and to de-water the slurry. The so-densified slurry is then subjected to a full vacuum for about ten to sixty minutes to form the final diaphragm.

In accordance with the present invention it has been found that the rate at which the vacuum is applied determines the ultimate packing of the fiber and thus, the pore size distribution. Therefore, in packing the fibers, it has been found that by applying a slow initial vacuum of from about one to two inches of mercury over a period of from about one-half to ten minutes allows uniform fiber orientation. This creates a denser mat of finer pore size distribution. Alternatively, this effect can, to some extent, be produced by reducing the fiber concentration in the slurry. However, the vacuum control is a more preferred method of fiber orientation.

Optionally, the fibers hereof can be preformed into a web and directly secured across a cathode screen. This technique is expecially effective in existing cells when the asbestos diaphragm must be replaced.

After deposition of the fibers, the cathode-diaphragm assemblies are heat treated to provide fiber to fiber cementation as noted hereinbefore.

Diaphragms produced in accordance herewith exhibit low electrical resistance and high resistance to chemical degradation.

Following are specific, non-limiting examples of the principles set forth herein. In the illustrative examples, all percentages are by weight.

EXAMPLE I

A five percent, by weight, aqueous slurry of polyethylene chlorotrifluoroethylene fibers having an average fiber diameter of 10 to 15 microns was prepared by dispersing the fibers in water. To the dispersion was added 0.01% by weight of a fluorocarbon surfactant sold by Minnesota Mining and Manufacturing under the name FLUORAD FC-170.

A cathode, mounted in a vacuum box, was then immersed in the slurry which was maintained in a state of agitation. A 1" Hg vacuum was applied across the vacuum box for about ten minutes, while submerged in the slurry, to deposit the fibers on the cathode screen.

Thereafter, the screen was heated at 250° C. for about one hour to self-bond the fibers. The entire fiber mat adhering to the screen.

The so-produced cathode was then mounted in a chlor-alkali electrolytic cell and the electrolysis of brine was carried out therewithin. The cell produced ninety grams per liter of caustic at greater than 95% current efficiency.

EXAMPLE II

A polyethylenechlorotrifluoroethylene fiber was produced by melt spinning the fiber in a Model CS-194 CSI-Masc Mixing Extruder at a temperature of about 540° F. to 550° F. The extruder had its drive motor and take up motor speeds adjusted and its header and rotor distances set such that the fiber wound on the take-up spool had a diameter of 0.1 micron. The so-produced fiber was cut further to provide a floc thereof.

The fiber was then dispersed in water to provide a 1% by weight, aqueous slurry thereof which, also, contained 0.01% by weight, of a fluorocarbon surfactant.

The fiber was deposited on a cathode screen by the same technique as outlined in Example I. In depositing the fiber, a vacuum cycle of 1" Hg for four minutes, 2" Hg for five minutes, and a full vacuum for five minutes was employed.

The cathode was then heat treated at 250° C. for one-half hour to bond the fibers. The cathode was then mounted in a chlor-alkali cell and tested by brine electrolysis. The fiber diaphragm performed satisfactorily at 90% current efficiency and 120 grams per liter caustic concentration.

EXAMPLE III

This example illustrates the permanent wettability of impregnated fluorocarbon-based fibers utilized in accordance with the present invention.

A 0.1 micron diameter polyethylene chlorotrifluoroethylene fiber was produced by the procedure outlined in Example II. Thereafter, a similar fiber was produced but which was impregnated with 0.1% by weight, of FLUORAD FC-126 fluorocarbon surfactant.

One gram of the latter fiber was sprinkled over a one liter beaker containing 900 mls. of distilled water. The sinking time of the fiber was observed as fifteen seconds. When this sinking test was conducted with the non-impregnated fiber, the fiber did not sink in five minutes.

EXAMPLE IV

Following the procedure of Example II, a 0.1 micron diameter fiber was prepared from polyvinylidene fluoride. The deposited fiber diaphragm was heat treated at 200° C. for about one hour to bond the fibers. The diaphragm was then tested in a chlor-alkali cell by brine electrolysis. The cell operated at 95% current efficiency at a 100 grams per liter caustic concentration.

EXAMPLE V

A preformed fiber web of a polyarylsulfone having a density of 2.06 pounds per square yard, a Gurley No. of 133 seconds and a thickness of 62.5 mils was installed in a test cell electrolyzed with brine. The cell produced 94 grams per liter of caustic at 95% current efficiency.

EXAMPLE VI

A less than 40 micron diameter fiber of chlorinated polyvinyl chloride was prepared by the melt spinning process defined in Belgian Pat. No. 795,724. The fibers were deposited in the manner described in Example I in the presence of the surfactant. The deposited diaphragm was heat treated at 150° C. for about one hour to bond the fibers. The diaphragm was mounted in a chlor-alkali test cell to produce 60 grams per liter of caustic at a 95% current efficiency.

Having thus described the invention, what is claimed is as follows:

1. In an electrolytic cell of the type having a diaphragm between the anode and cathode, the improvement which comprises:

a diaphragm consisting essentially of discrete fibers of a self-bonding thermoplastic material, the fibers having a diameter of between 0.05 and 40 microns, each of the fibers containing from about 0.01 to about ten percent, by weight, based on the weight of the fibers, of a surfactant.

2. The improvement of claim 1 wherein the diaphragm comprises a preformed web of the thermoplastic material.

3. The improvement of claim 1 wherein the diaphragm is a vacuum deposited slurry on the cathode screen.

4. The improvement of claim 1 wherein the electrolytic cell is a chlor-alkali cell.

5. The improvement of claim 1 wherein the thermoplastic material is a fluorohydrocarbon.

6. The improvement of claim 5 wherein the fluorohydrocarbon is admixed with a thermoplastic material selected from the group consisting of substituted or unsubstituted polyolefins, polycarbonates, polyamides, polyesters and mixtures thereof.

7. The improvement of claim 6 wherein the admixed thermoplastic material is selected from the group consisting of polyethylene, polypropylene, hexamethylene adipamide, polyethylene terephthalate, poly-4-methylpentene-1, poly(tetramethylene) terephthalate, polystyrene-polyvinylidene chloride copolymers, polyphenylene oxide and mixtures thereof.

8. The improvement of claim 5 wherein the fluorohydrocarbon material is selected from the group consisting of polytetrafluoroethylene, fluorinated ethylene-propylene copolymers, polychlorotrifluoroethylene, polyvinylidenefluoride, polyethylenechlorotrifluoroethylene, polyethylenetetrafluoroethylene, tetrafluoroethylene, perfluorovinylether sulfonyl fluoride copolymer, and mixtures thereof.

9. The improvement of claim 1 wherein the surfactant is selected from the group consisting of oxyalkylene condensates of ethylene diamine, perfluorinated fatty acids or alcohols, sulfonate-based surfactants, polyoxyethylene alkylphenols, polyoxyethylene alcohols, polyoxyethylene esters of fatty acids, polyoxyethylene mercaptans, polyoxyethylene alkylamines, polyoxyethylene alkylamides and polyols.

10. The improvement of claim 1 wherein each of the fibers contain from about 0.1 to 25%, by weight, of an inorganic wetting agent, based on the weight of the fiber.

11. The improvement of claim 10 wherein the inorganic wetting aids are selected from the group consisting of asbestos, mica, titanates, talc, vermiculite stable inorganic oxides, kaolinite, diatomaceous earth clays and mixtures thereof.

12. In an electrolytic cell of the type having a diaphragm between the anode and the cathode, the improvement which comprises:

a diaphragm consisting essentially of discrete fibers of a self-bonding thermoplastic material, the fibers having a diameter of between 0.05 and 40 microns, each of the fibers containing from about 0.01 to about ten percent, by weight, based on the weight of the fibers, of an organic surfactant.

13. The improvement of claim 12 wherein the surfactant is selected from the group consisting of oxyalkylene condensates, of ethylene diamine, perfluorinated fatty acids or alcohols, sulfonate-based surfactants, polyoxyethylene alkylphenols, polyoxyethylene alcohols, polyoxyethylene esters of fatty acids, polyoxyethylene mercaptans, polyoxyethylene alkylamines, polyoxyethylene alkylamides and polyols.

14. In an electrolytic cell of the type having a diaphragm between the anode and the cathode, the improvement which comprises:

a diaphragm consisting essentially of discrete fibers of a self-bonding thermoplastic material, the fibers having a diameter of between 0.05 and 40 microns, each of the fibers containing from about 0.01 to about ten percent, by weight, based on the weight of the fibers, of an inorganic surfactant.

15. The electrolytic cell of claim 14 wherein the inorganic wetting aids are selected from the group consisting of asbestos, mica, titanates, talc, vermiculite stable inorganic oxides, kaolinite, diatomaceous earth clays and mixtures thereof.

* * * * *

UNITED STATES PATENT AND TRADEMARK OFFICE

CERTIFICATE OF CORRECTION

PATENT NO. : 4,210,515

DATED : July 1, 1980

INVENTOR(S) : Arvind S. Patil and Shyam D. Argade

It is certified that error appears in the above-identified patent and that said Letters Patent are hereby corrected as shown below:

Claim 10 should read as follows:

The improvement of claim 1 wherein each of the fibers contain from about 0.1 to 10 percent by weight, of an inorganic setting agent, based on the weight of the fiber.

Signed and Sealed this

*Fourth* Day of *November 1980*

[SEAL]

*Attest:*

SIDNEY A. DIAMOND

*Attesting Officer*

*Commissioner of Patents and Trademarks*